United States Patent [19]

Okabayashi

[11] 4,112,888

[45] Sep. 12, 1978

[54] IGNITION TIMING CONTROLLER FOR A GASOLINE ENGINE

[75] Inventor: Keiichi Okabayashi, Aichi, Japan

[73] Assignee: Toyota Jidosha Kogyo Kabushiki Kaisha, Toyota, Japan

[21] Appl. No.: 681,040

[22] Filed: Apr. 28, 1976

[30] Foreign Application Priority Data

Dec. 26, 1975 [JP] Japan ..... 50-176951[U]

[51] Int. Cl.[2] ..... F02P 5/14

[52] U.S. Cl. ..... 123/117 A

[58] Field of Search ..... 123/117 A

[56] References Cited

U.S. PATENT DOCUMENTS

| | | | |
|---|---|---|---|
| 2,659,353 | 11/1953 | Mallory | 123/117 A |
| 3,400,698 | 9/1968 | Kelly | 123/117 A |
| 3,503,377 | 3/1970 | Beatenbough | 123/117 A |
| 3,678,907 | 7/1972 | Vartanian | 123/117 A |
| 3,680,533 | 8/1972 | Soberski | 123/117 A |
| 3,800,758 | 4/1974 | Sutherland | 123/117 A |
| 3,812,832 | 5/1974 | Scott | 123/117 A |
| 3,828,743 | 8/1974 | Ludwig | 123/117 A |
| 3,841,551 | 10/1974 | Ota | 123/117 A |
| 3,871,341 | 3/1975 | Kalogerson | 123/117 A |
| 3,913,539 | 10/1975 | Winkley | 123/117 A |
| 3,923,023 | 12/1975 | Ito | 123/117 A |
| 3,935,843 | 2/1976 | Ludwig | 123/117 A |
| 3,948,232 | 4/1976 | Gould et al. | 123/117 A |
| 3,954,090 | 5/1976 | Ota | 123/117 A |
| 3,960,321 | 6/1976 | Steele | 123/117 A |
| 3,963,042 | 6/1976 | Bible | 123/117 A |
| 3,987,770 | 10/1976 | Nomura | 123/117 A |
| 4,008,697 | 2/1977 | Konno | 123/117 A |

*Primary Examiner*—Charles J. Myhre
*Assistant Examiner*—Jeffrey L. Yates
*Attorney, Agent, or Firm*—Stevens, Davis, Miller & Mosher

[57] ABSTRACT

An ignition timing controller for a gasoline engine on an automobile or the like. The apparatus comprises a thermo sensor actuated in response to variation in an engine cooling water temperature and a negative pressure delay valve. The thermo sensor has a first port connected to an advancer port opening to a carburetor and located near a throttle valve, a second port connected to an advance control port opening into the carburetor and located above the advancer port and a third port connected to a negative pressure chamber of a vacuum advancer. When the water temperature is at a predetermined value or lower, the first and third ports of the thermo sensor are connected with each other through the interior of the thermo sensor. When the water temperature becomes higher than the predetermined value, the first and second ports of the thermo sensor are connected with each other through the thermo sensor. The negative pressure delay valve is divided by a partition into two chambers, one of which is connected to a passage which connects the advancer port of the carburetor and the thermo sensor and the other of which is connected to a passage which connects the thermo sensor and the negative pressure chamber of the vacuum advancer. The partition is provided with an orifice and a check valve adapted to permit fluid flow only in a direction from the one to the other chamber of the negative pressure delay valve. A throat is provided in the second port of the thermo sensor. Thus, when the water temperature is at or lower than a predetermined value, ignition timing is advanced, whereby good performance of the engine is maintained. When the water temperature is higher than the predetermined value, the distributor advance angle is determined according to the opening of the throttle valve and a deep press-down and instant release of the accelerator pedal will not cause advance of ignition timing.

3 Claims, 1 Drawing Figure

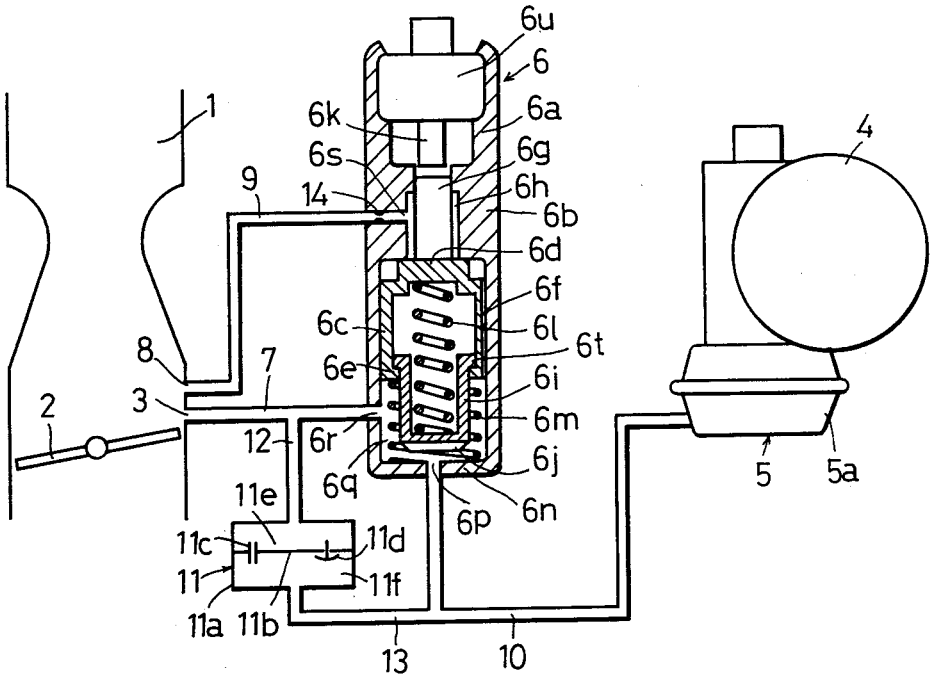
6u
6
1
6k
6a
4
6s
6g
9
14
6h
6b
6d
6f
6c
6l
6t
8
7
6e
6i
2
3
6m
12
6r
6j
5
5a
6q
11e
6n
6p
11c
11d
11
11f
11a
11b
13
10

IGNITION TIMING CONTROLLER FOR A GASOLINE ENGINE

BACKGROUND OF THE INVENTION

This invention relates to an ignition timing controller for a gasoline engine on an automobile and the like.

In a known gasoline engine for an automobile or the like, when a throttle valve in a carburetor is opened to such an extent that its upper edge is rotated slightly above an advancer port opening to the carburetor, the negative pressure prevailing behind the throttle valve is transmitted through the advancer port into a negative pressure chamber vacuum a vacum advancer which controls the timing for distribution of igniting voltage by a distributor, and ignition timing is advanced, whereby combustion of a fuel-air mixture in engine cylinders is improved and consequently good engine performance is maintained. The improvement of combustion, however, results in rise of combustion temperature, causing in some cases generation of NO*x* (nitrogen oxides) as the result of a reaction between $N_2$ and $O_2$ in fuel gas. Emission of NO*x* must be controlled in order to purify exhaust gas; therefore, in some operation range of an engine, it is necessary to retard ignition timing or decrease the distributor advance angle in order to reduce NO*x* or HC (hydrocarbons).

SUMMARY OF THE INVENTION

An object of this invention is to provide an ignition timing controller which maintains good engine performance when the engine temperature is at a predetermined value or lower.

Another object of this invention is to provide an ignition timing controller which maintains a small distributor advance angle to reduce emission of NO*x*, when the engine temperature is higher than the predetermined value and a throttle valve is not so widely open.

Still another object of this invention is to provide an ignition timing controller which advances ignition timing to thereby allow the engine to maintain good performance when the engine temperature is higher than the predetermined value and the driving speed is increased.

A further object of this invention is to provide an ignition timing controller in which when the engine temperature is higher than the predetermined value, momentary wide opening of a throttle valve does not allow the ignition timing to be advanced, resulting in decrease of NO*x* and HC emissions.

BRIEF DESCRIPTION OF THE DRAWING

A preferred embodiment of this invention is schematically shown partly in section in the accompanying drawing.

DETAILED DESCRIPTION OF THE EMBODIMENT

In the drawing numeral 1 indicates a carburetor and numeral 2 indicates a throttle valve in its closed or idling position. An advancer port 3 opens to the carburetor 1 at a position slightly above the leading edge of the throttle valve in that position as shown in the drawing. Ignition timing or timing for igniting voltage distribution by a distributor 4 is controlled by a vacuum advancer 5 in which a diaphragm defines a negative pressure chamber 5*a*. A thermosensor 6 is mounted, for example, on an engine cooling jacket not shown and detects the water temperature. The thermosensor 6 includes an outer cylinder 6*a* constricted to form an elongate, radially inwardly projecting flange 6*b* approximately in the middle part thereof. An intermediate cylinder 6*c* is slidably inserted in the outer cylinder 6*a* so that its upper end 6*d* is engageable with the lower edge of the flange 6*b*. The intermediate cylinder 6*c* has a lower edge projecting radially inwardly to form a flange 6*e*. An axially extending air channel 6*f* is cut on the outer surface of the intermediate cylinder 6*c*. A rod 6*g* extends through the flange 6*b* with a clearance 6*h* therebetween, and is attached to the upper end 6*d* of the intermediate cylinder 6*c*. An inner cylinder 6*i* which is slidable along the inner surface of the intermediate cylinder 6*c* projects downwardly from the intermediate cylinder 6*c*. The upper edge of the inner cylinder 6*i* projects radially outwardly to form a flange 6*t* which engages with the flange 6*e* of the intermediate cylinder 6*c*. A valve element 6*j* is carried on the projecting end of the inner cylinder 6*i*. A thermo wax 6*k* which expands or controls in response to variation in the engine cooling water temperature is carried on a support 6*u* located in the upper end portion of the outer cylinder 6*a*, and faces the rod 6*g*. When the thermowax 6*k* expands, it applies downward pressure onto the upper end of the rod 6*g* and causes it to push down the intermediate cylinder 6*c*. A compression spring 6*l* is provided between the intermediate cylinder 6*c* and the inner cylinder 6*i* in order to normally ensure engagement between the flange 6*t* of the inner cylinder 6*i* and the flange 6*e* of the intermediate cylinder 6*c*. The intermediate cylinder 6*c* is normally pressed against the flange 6*b* of the outer cylinder 6*a* by a compression spring 6*m* provided between the lower end of the outer cylinder 6*a* and the flange 6*e* of the intermediate cylinder 6*c*. A port 6*p* opens in the lower end 6*n* of the outer cylinder 6*a*, in a position facing the valve element 6*j* carried on the inner cylinder 6*i*. There are provided a port 6*r* opening to a clearance 6*q* between the inner cylinder 6*i* and the outer cylinder 6*a* and a port 6*s* opening to the clearance 6*h*. A throat 14 is provided in the port 6*s*.

The port 6*r* of the thermosensor 6 is connected through a passage 7 to the advancer port 3 of the carburetor 1 and the port 6*s* is connected through a passage 9 to an advance control port 8 opening slightly above the advancer port 3 to the carburetor 1 as shown in the drawing. The port 6*p* is connected through a passage 10 to the negative pressure chamber 5*a* of the vacuum advancer 5. The throat 14 may be provided in the passage 9 instead of the port 6*s*.

A negative pressure delay valve 11 has a casing 11*a* in which a partition 11*b* having an orifice 11*c* and a check valve 11*d* defines a negative pressure chamber 11*e* on one side and a negative pressure delay chamber 11*f* on the other side. The check valve 11*d* is adapted to permit fluid flow only in a direction from the negative pressure chamber 11*e* to the negative pressure delay chamber 11*f*, so that the check valve 11*d* remains closed when the negative pressure in the negative pressure chamber 11*e* is higher than that in the negative pressure delay chamber 11*f* (or the pressure in the negative pressure chamber 11*e* is more below the atmospheric pressure than that in the negative pressure delay chamber 11*f*), and the negative pressure in the negative pressure chamber 11*e* is gradually transmitted to the negative pressure delay chamber 11*f* through the orifice 11*c*. The negative pressure chamber 11*e* is connected to the passage 7 through a passage 12 and the negative pressure delay chamber 11*f* is connected to the passage 10 through a passage 13.

In the above embodiment, when the engine cooling water temperature is at a predetermined value or lower, the thermowax 6*k* remains in its contracted state and is apart from the upper edge of the rod 6*g*. The upper end 6*d* of the intermediate cylinder 6*c* remains in sealing contact with the flange 6*b* of the outer cylinder 6*a* under the action of the compression spring 6*m*, whereby fluid tightness is maintained therebetween. The flange 6*t* of the inner cylinder 6*i* is maintained in engagement with the flange 6*e* of the intermediate cylinder 6*c* under the action of the compression spring 6*l*. Accordingly, when the engine cooling water is at a predetermined valve or lower, the valve element 6*j* stays above the bottom 6*n* of the outer cylinder 6*a*, so that the port 6*p* remains open in communication with the port 6*r* through the clearance 6*q* around the inner cylinder 6*i*. Thus, the negative pressure at the advancer port 3 from behind the throttle valve 2, when it is rotated from its closed or idling position to a position in which its leading edge is between the advancer port 3 and the advance control port 8, is transmitted to the negative pressure chamber 5*a* of the vacuum advancer 5 through the passage 7, the ports 6*r* and 6*p* and the passage 10, to actuate the distributor 4, whereby ignition timing is advanced to maintain good performance of the engine.

When the water temperature rises, the thermowax 6*k* expands and makes pressure contact with the upper end of the rod 6*g* to cause it to press down the intermediate cylinder 6*c* against the action of the compression spring 6*m*. The valve element 6*j* is lowered under the action of the compression spring 6*l* to close the port 6*p*. At the same time, a clearance is formed between the upper end 6*d* of the intermediate cylinder 6*c* and the flange 6*b* of the outer cylinder 6*a*, and establishes a fluid communication between the ports 6*s* and 6*r* through the air channel 6*f* on the intermediate cylinder 6*c*. When the upwardly turned edge of the throttle valve 2 is between the advancer port 3 and the advance control port 8, the fluid having a high negative pressure drawn through the advancer port 3 into the passage 7 is diluted there by fluid having a low negative pressure reaching through the advance control port 8, the throat 14 and the ports 6*s* and 6*r*, and the resultant fluid having a reduced negative pressure is drawn into the negative pressure delay valve 11 and transmitted therefrom through the passages 13 and 10 to the negative pressure chamber 5*a* of the vacuum advancer 5. As this fluid has a considerably reduced negative pressure, the distributor 4 permits only a small advance in ignition timing as compared with what is accomplished by a device known in the art. It will, thus, be noted that the magnitude of advance in ignition timing is controlled according to the size in cross section of a fluid passage through the throat 14.

If the automobile speed is increased and consequently the throttle valve 2 is further opened to locate its upper edge above the advance control port 8 when the port 6*p* is closed by the valve element 6*j*, the fluid having a relatively high negative pressure is drawn through the advancer port 3 and the advance control port 8 into the negative pressure delay valve 11, and is, after a brief delay, transmitted to the negative pressure chamber 5*a* of the vacuum advancer 5. Thus, ignition timing is advanced by the distributor 4 as done in the prior art, whereby good performance of the engine may be maintained.

If the throttle valve 2 is opened only briefly to the position in which its upper edge is rotated above the advance control port 8, a certain time lag obtainable by the negative pressure delay valve 11 is useful to prevent any sudden advance in ignition timing, though fluid having a high negative pressure is introduced through the advance control port 8 as well as the advancer port 3. Therefore, according to this invention, momentary press-down and instant release of the accelerator pedal does not cause any appreciable advance in ignition timing, so that considerable reduction in NO*x* and HC emissions can be attained over any prior art devices of this sort.

What is claimed is:

1. An ignition timing controller for a gasoline engine comprising:

a thermosensor having a first port connected through a first passage to an advancer port opening to a carburetor, said advancer port opening being located at a portion above the upper edge of a throttle valve when in closed position, a second port connected through a second passage to an advance control port opening to said carburetor and located above said advancer port and a third port connected through a third passage to a vacuum advancer of a distributor, said first port being adapted for communication with said third port through said thermosensor over a first engine temperature range no higher than a predetermined value, and with said second port through said thermosensor over a second engine temperature range higher than said predetermined value, said communication of said first and second ports being cut off over said first temperature range and said communication of said first and third ports being cut off over said second temperature range;

a negative pressure delay valve, connected to said first passage and said third passage, for delaying transmission of negative pressure from said carburetor to said vacuum advancer when negative pressure is increased from a predetermined level and for transmitting negative pressure from said carburetor to said vacuum advancer without delay when negative pressure is decreased; and a throat in said second passage.

2. An ignition timing controller for a gasoline engine as defined in claim 1, wherein said thermosensor comprises an outer cylinder having said first, second and third ports, an intermediate cylinder inserted in said outer cylinder slidably on the inner surface of said outer cylinder, an inner cylinder inserted in said intermediate cylinder slidably on the inner surface of said intermediate cylinder and carrying at one end a valve element adapted to open and close said third port, a thermowax carried on one end of said outer cylinder and adapted for expansion in response to elevation of engine temperature to bring itself into operational engagement with one end of said intermediate cylinder and first and second compression springs provided between said intermediate and outer cylinders and between said inner and intermediate cylinders, respectively.

3. An ignition timing controller for a gasoline engine as defined in claim 1, wherein said negative pressure delay valve comprises a substantially totally closed casing, a partition defining two negative pressure chambers in said casing, an orifice and a check valve formed through said partition, and a port formed through said casing and opening into each of said negative pressure chambers.

* * * * *